US008215681B2

(12) United States Patent
Stevenson

(10) Patent No.: US 8,215,681 B2
(45) Date of Patent: Jul. 10, 2012

(54) JEWELRY LOOM

(76) Inventor: Lesley Stevenson, Sagle, ID (US)

( * ) Notice: Subject to any disclaimer, the term of this patent is extended or adjusted under 35 U.S.C. 154(b) by 0 days.

(21) Appl. No.: 12/889,444

(22) Filed: Sep. 24, 2010

(65) Prior Publication Data

US 2012/0074697 A1 Mar. 29, 2012

(51) Int. Cl.
*B65H 69/04* (2006.01)

(52) U.S. Cl. ..... 289/2; 289/16.5

(58) Field of Classification Search ..... 289/2, 13, 289/16.5; 223/120
See application file for complete search history.

(56) References Cited

U.S. PATENT DOCUMENTS 863,820 A * 8/1907 Wingert ..... 223/90
3,688,357 A * 9/1972 Nielsen et al. ..... 289/17
4,109,946 A * 8/1978 Williams ..... 289/16.5
4,111,471 A * 9/1978 Hanley ..... 289/16.5
4,124,237 A * 11/1978 Catania ..... 289/16.5
4,186,951 A * 2/1980 Stephenson ..... 289/16.5
D369,482 S * 5/1996 McArdle ..... D6/450
6,182,871 B1 * 2/2001 Lam ..... 223/120
6,978,974 B1 * 12/2005 Marasco ..... 248/124.1
7,246,463 B1 * 7/2007 Arnot ..... 47/42
7,311,289 B2 * 12/2007 Mori ..... 248/165
D586,624 S * 2/2009 Goodman et al. ..... D7/601
2004/0124323 A1 * 7/2004 Kamenstein ..... 248/121
2005/0258318 A1 * 11/2005 Mori ..... 248/175

* cited by examiner

*Primary Examiner* — Shaun R Hurley
(74) *Attorney, Agent, or Firm* — The Law Office of Jerry D. Haynes

(57) ABSTRACT

A jewelry loom for assisting in jewelry knotting comprising: a base; a knotting bow, where said knotting bow extends vertically from the base; a hook, where the hook extends downwardly from a top end of the bow; and a plurality of advancement knobs along the length of the bow. In the one particular embodiment, the bow extends from the base at an angle. The base may also include a cleat, where the cleat is used as a further mounting piece for the twines during the knotting process. The bow may also include a connecting wedge, where the wedge slides into a receiving slot in the base.

3 Claims, 2 Drawing Sheets

JEWELRY LOOM

BACKGROUND OF THE INVENTION

1. Field of Invention

The present invention relates to a loom to assist a craftsman in the creation of jewelry in particular hemp jewelry.

2. Description of Related Art

Hemp jewelry involves the knotting of hemp twine through the practice of macramé. Various types of jewelry produced through the use of hemp twining such as bracelets, necklaces, anklets, rings, watches or other types of jewelry. Some of the jewelry also includes beads made of glass, stone, wood or possibly bones. The hemp twine is intertwined by using the macramé art of knotting the twines in various geometric patterns. This knotting is done without hooks, needles or hoops and the knotting itself is an art form that is used to create the jewelry. Other than hemp, other natural fibers may be utilized such as cotton, jute, sisal, linen and as mentioned above hemp. These natural fibers are processed into strands and thus used to intertwine to create jewelry by using the macramé technique.

When creating jewelry by using macramé it is necessary to mount or at least secure the twines at a base point while the knotting occurs. Many times jewelry makers use any stationary object that is suitable to hold at least one end of the jewelry in place while the knotting takes place. The disadvantages of not having a tool to assist in mounting the strands are obvious. A user must find a random object or just create a particular object for the purpose and therefore may have various inconsistencies with respect to the knotting process. Further if it is required to stop the knotting or to maneuver the strands it is difficult without a specific device for macramé jewelry making.

Consequently it would be advantageous to have a device that a hobbyist or crafter could use to create the hemp or strand jewelry through the use of macramé. It also would be advantageous to have a device that is portable and easy to use and assemble for jewelry creation.

SUMMARY OF THE INVENTION

The present invention relates to a jewelry loom for assisting in jewelry knotting comprising: a base; a knotting bow, where said knotting bow extends vertically from the base; a hook, where the hook extends downwardly from a top end of the bow; and a plurality of advancement knobs along the length of the bow. In the one particular embodiment, the bow extends from the base at an angle. The base may also include a cleat, where the cleat is used as a further mounting piece for the twines during the knotting process. The bow may also include a connecting wedge, where the wedge slides into a receiving slot in the base.

DETAILED DESCRIPTION

The present invention relates to a jewelry loom that is utilized for crafting and creating jewelry and in particular hemp jewelry. The jewelry loom according to the present invention provides a secure device that allows a jewelry maker to secure the tying loom into a position while creating the knotted assembly of the jewelry. The jewelry loom includes a sturdy base and a knotting bow with a hook provided at one end of the knotting bow and a cleat provided at one end of the base to secure the strands while performing the knotting process.

Figure 1A:
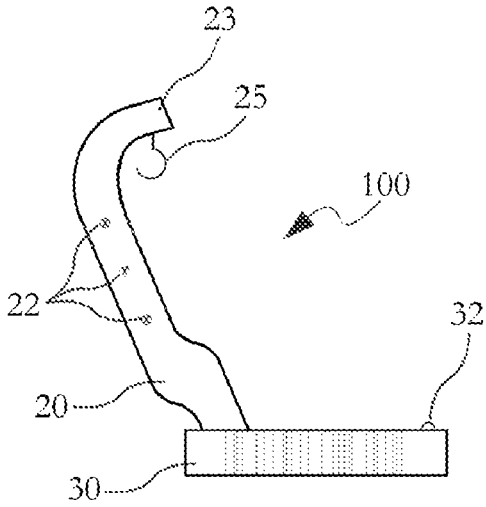
FIG. 1A provides a side view of a jewelry loom according to the present invention.

In reference to FIG. 1A, a side view of the Jewelry Loom 100 according to the present invention is depicted. The Jewelry Loom 100 includes a Base 30 that secures a Knotting Bow 20. The Knotting Bow 20 extends from the Base 30 vertically and in this particular embodiment at an angle. The Bow 20 includes a Top End 23 which includes a Hook 25 that extends downwardly from the top end of Bow 23. Along the length of the Bow 20 is a plurality of Advancement Knobs 22. The use of the Loom 100 intertwines the strands around the Hook 25 and then proceeds with the knotting process as desired. Advancement Knobs 22 are used as a means to further assist the user in the intertwining process.

The Base 30 includes a Cleat 32 that is used as a further mounting piece for the twines during the knotting process. A user of the Loom 100 may begin the knotting through the use of the Hook 25 and then continue lacing and knotting by using the Cleat 32 on the Base 30.

Figure 1B:
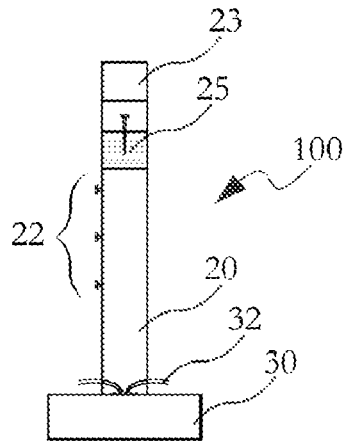
FIG. 1B depicts a front view of the jewelry loom according to the present invention.

In reference to FIG. 1B, a front view of the Loom 100 is depicted. The front view provides a clearer view of the Cleat 32 that includes two extending arms. The Cleat 32 allows a user to loop the strands through the Cleat 32 and continue the twining process through the assistance of the Hook 25 and Adjustment Knobs 22.

Figure 1C:
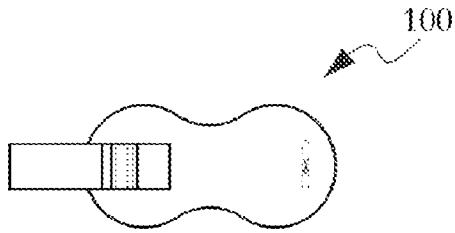
FIG. 1C depicts a top view of the jewelry loom according to the present invention.

FIG. 1C depicts a top view of the Loom 100 according to the present invention. The top view simply provides a view where the Base 30 is shown extending horizontally from the Knotting Bow 23. The Base 30 provides a firm secure base for the loom and helps to keep the loom stationary during the knotting process. Further, Base 30 may be of substantial weight so that it helps to keep the Loom 100 sturdy.

Figure 2:
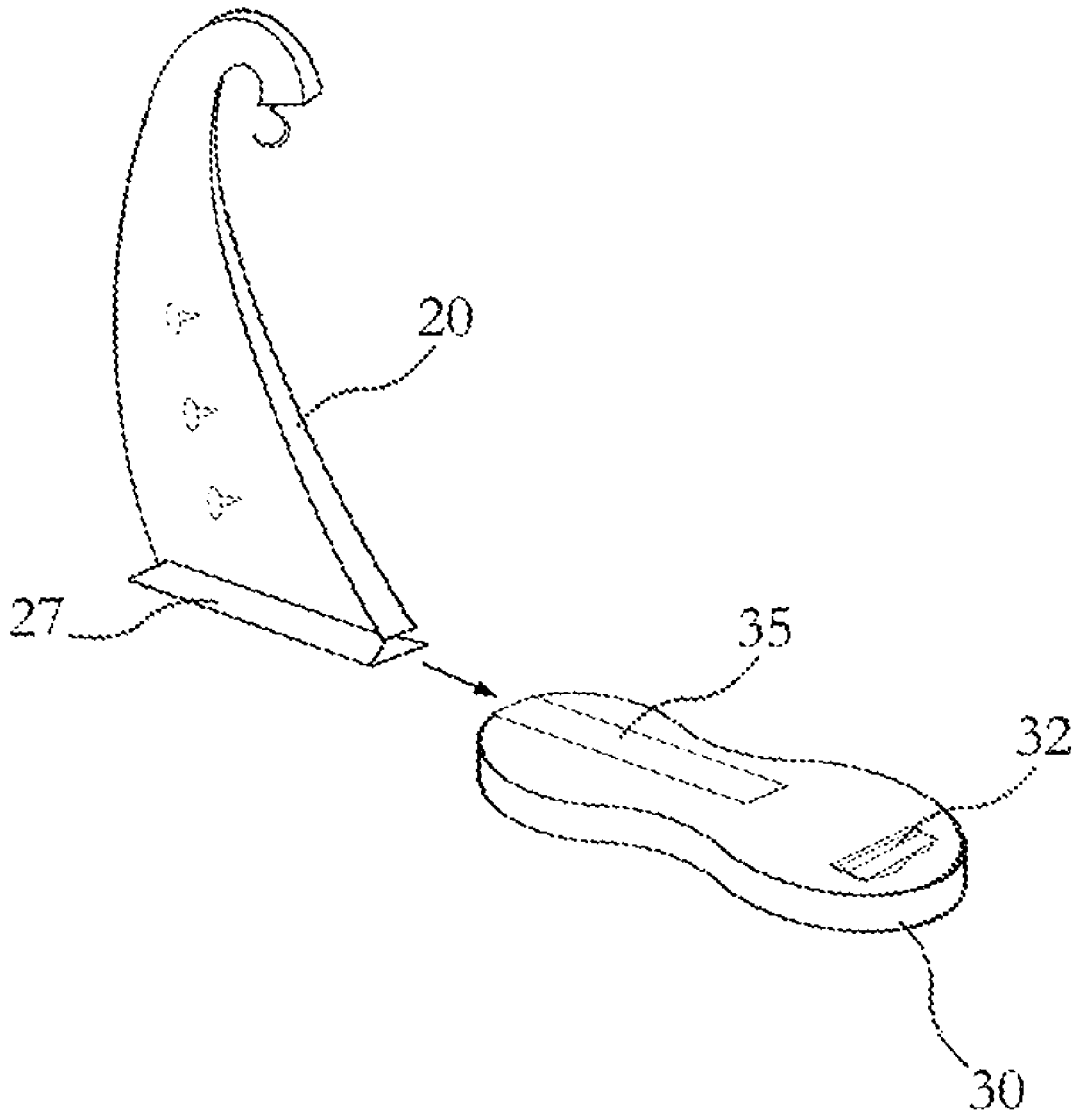
FIG. 2 depicts a perspective view of the components of the jewelry loom according to the present invention.

FIG. 2 depicts a perspective view of the Knotting Bow 20 and Base 30 where each component is shown separately. In this particular embodiment, a Connecting Wedge 27 is shown at the bottom of the Bow 20 that slides into a Receiving Slot 35 at the Base 30. This feature allows a user to dismantle the Jewelry Loom 100 into two pieces for storage. Further the Wedge 27 is of sufficient size so it snuggly fits into the Slot 35 provided on the Base 30.

The jewelry loom according to the present invention is a loom provided for jewelry tying and enables users to securely position materials while fabricating various types of jewelry and in particular hemp jewelry. The loom allows for the manual operating of the various components such as the Hook 25, Advancement Knobs 22 and Cleat 32. The loom is durable and may be made of plastic or other sturdy materials such as metals or even wood. The instant invention has been shown and described in what it considers to be the most practical and preferred embodiments. It is recognized, however, that departures may be made there from within the scope of the invention and that obvious modifications will occur to a person skilled in the art.

What is claimed is:

1. A jewelry loom for assisting in jewelry knotting comprising:

a. a base;

b. a rectangular knotting bow, where said knotting bow extends vertically at an angle greater than 90 degrees from the base;

c. a hook, where the hook extends downwardly from a top end of the bow; and d. three advancement knobs aligned in parallel along the length of the bow.

2. The jewelry loom according to claim 1, where the base includes a cleat, where the cleat is used as a further mounting piece for the twines during the knotting process.

3. The jewelry loom according to claim 1, where the bow includes a connecting wedge, where the wedge slides into a receiving slot in the base.

* * * * *